US011598146B2

(12) United States Patent
Conboy

(10) Patent No.: US 11,598,146 B2
(45) Date of Patent: Mar. 7, 2023

(54) DRAPE ELEMENT AND SELF-ALIGNING DRAPE ASSEMBLY

(71) Applicant: John S. Conboy, Chesterfield, MO (US)

(72) Inventor: John S. Conboy, Chesterfield, MO (US)

(73) Assignee: Conform International, Naples, FL (US)

( * ) Notice: Subject to any disclaimer, the term of this patent is extended or adjusted under 35 U.S.C. 154(b) by 191 days.

(21) Appl. No.: 15/930,638

(22) Filed: May 13, 2020

(65) Prior Publication Data

US 2021/0355754 A1 Nov. 18, 2021

(51) Int. Cl.

| | |
|---|---|
| ***A47H 23/02*** | (2006.01) |
| ***E06B 9/36*** | (2006.01) |
| ***E06B 9/386*** | (2006.01) |
| ***A47H 23/05*** | (2006.01) |
| ***A47H 23/10*** | (2006.01) |

(Continued)

(52) U.S. Cl.

CPC ..... *E06B 9/367* (2013.01); *A47H 23/01* (2013.01); *A47H 23/05* (2013.01); *A47H 23/10* (2013.01); *A47H 23/14* (2013.01); *E06B 9/386* (2013.01); *A47H 2201/01* (2013.01)

(58) Field of Classification Search

CPC ..... A47H 23/05; A47H 2201/00; A47H 2201/01; A47H 23/01; A47H 23/04; A47H 23/08; A47H 23/10; A47H 23/14; E06B 9/367; E06B 9/386

See application file for complete search history.

(56) References Cited

U.S. PATENT DOCUMENTS 2,884,055 A * 4/1959 Scholer ..... A47H 13/16 160/348
3,001,578 A * 9/1961 Ratliff ..... A47H 13/16 160/126

(Continued)

FOREIGN PATENT DOCUMENTS

CN 204394146 U 9/1989
CN 101669758 A 3/2010

(Continued)

OTHER PUBLICATIONS

International search report for international application No. PCT/US2021/029923.

*Primary Examiner* — Johnnie A. Shablack
(74) *Attorney, Agent, or Firm* — Quinn IP Law

(57) ABSTRACT

A drape element includes a sheet of flexible, non-magnetic material having opposed first and second longitudinal sheet edges, a longitudinal centerline toward which is defined an inward direction and away from which is defined an outward direction, and a first longitudinal pocket disposed proximate the first longitudinal sheet edge. A first straight magnetic wire is disposed in the longitudinal direction within an inward longitudinal portion of the first longitudinal pocket, and a first alternating sequence of magnets and non-magnetic spacers is disposed within an outward longitudinal portion of the first longitudinal pocket. Each of the magnets has opposed first and second magnetic poles, with a respective first magnetic pole of each of the magnets being disposed in contact with the first straight magnetic wire.

20 Claims, 4 Drawing Sheets

(51) Int. Cl.
*A47H 23/14* (2006.01)
*A47H 23/01* (2006.01)

(56) References Cited

U.S. PATENT DOCUMENTS 3,827,019 A * 7/1974 Serbu ..... A41F 1/002 335/285
4,623,061 A * 11/1986 Pentith ..... B65G 15/64 198/805
4,802,523 A * 2/1989 Scholten ..... F16B 5/00 160/354
5,251,182 A * 10/1993 Carpenter ..... G01V 1/208 174/101.5
5,347,253 A * 9/1994 Ogikubo ..... A63F 9/34 446/92
5,524,689 A * 6/1996 Clark ..... A47H 13/04 160/124
7,154,363 B2 * 12/2006 Hunts ..... H01F 7/0242 446/92
7,770,243 B1 * 8/2010 Wise ..... A47H 13/02 4/557
9,345,357 B1 * 5/2016 Davila, Jr. ..... E06B 7/28
10,301,851 B1 * 5/2019 Cummings ..... B60R 7/04
2004/0006902 A1 * 1/2004 Zarelius ..... G09F 7/04 40/605
2004/0011480 A1 * 1/2004 Andre de la Porte . A47H 23/01 160/238
2009/0266498 A1 * 10/2009 Cooper ..... E06B 9/13 24/442
2012/0067531 A1 * 3/2012 Ehrsam ..... H01F 7/0252 160/368.1
2013/0112355 A1 * 5/2013 Roth ..... A47H 23/00 160/127
2014/0166215 A1 * 6/2014 Thomas ..... A47H 2/00 160/38
2016/0114560 A1 4/2016 Hollingsworth
2017/0086616 A1 * 3/2017 Hickey ..... A47H 23/00
2017/0202404 A1 * 7/2017 Pandaleon ..... A47H 23/01
2019/0239675 A1 * 8/2019 Northey ..... H01F 7/02
2020/0124275 A1 * 4/2020 Diloyan ..... F23C 99/001
2020/0170435 A1 * 6/2020 Hannula ..... A47H 23/00
2022/0225813 A1 * 7/2022 Garfinkel ..... A47H 23/01

FOREIGN PATENT DOCUMENTS

CN 104026955 A 9/2014
KR 20140003123 U 5/2014

* cited by examiner

DRAPE ELEMENT AND SELF-ALIGNING DRAPE ASSEMBLY

INTRODUCTION

This disclosure relates generally to drape elements and self-aligning drape assemblies.

Some walk-in cooler and freezer compartments include a strip curtain across the entrance into the compartment. Such strip curtains typically include multiple strips made of plastic suspended from the top of the entrance, with the strips arranged closely side-by-side. This allows personnel to easily move the strips out of the way in order to enter and exit the compartment, after which the strips will typically resume their side-by-side arrangement. This not only permits easy entrance and egress, but also helps keep the refrigerated air within the compartment and the warmer external air from entering the compartment.

Strip curtains may also be used for applications other than cooler and freezer compartments, such as in doorways between adjacent rooms or around beds in hospitals, in order to provide privacy. They may also be used as part of moveable structures that may be placed around objects or sites for security purposes. For such uses other than cooler and freezer compartments, the strip curtains may be fabricated from cloth or other flexible materials.

However, the individual strips of these strip curtains do not always seal well against adjacent strips. For cooler and freezer applications, this permits refrigerated air to escape and/or warmer external air to enter into the refrigerated compartment. And for privacy and security applications, it permits unwanted view. Further, if the whole strip curtain or individual strips of the strip curtain are rolled up (such as for transport or storage), the strips may not readily resume their desired straightened-out shape when unrolled, and may take some time to do so.

SUMMARY

According to one embodiment, a drape element includes a generally elongate sheet of flexible, non-magnetic material having opposed first and second longitudinal sheet edges defining a longitudinal direction, a longitudinal centerline toward which is defined an inward direction and away from which is defined an outward direction, and a first longitudinal pocket disposed proximate the first longitudinal sheet edge. The first longitudinal pocket is formed by: (i) a first longitudinal edge portion of the sheet proximate the first longitudinal sheet edge being turned and fastened to a main portion of the sheet, or (ii) a first binding strip having opposed longitudinal first strip edges being longitudinally folded about the first longitudinal sheet edge and the longitudinal strip edges being fastened to the main portion of the sheet. A first straight magnetic wire is disposed in the longitudinal direction within an inward longitudinal portion of the first longitudinal pocket, and a first alternating sequence of magnets and non-magnetic spacers is disposed within an outward longitudinal portion of the first longitudinal pocket. Each of the magnets has opposed first and second magnetic poles, wherein a respective first magnetic pole of each of the magnets is disposed in contact with the first straight magnetic wire.

The flexible, non-magnetic material may be woven fabric, felted fabric, leather, artificial leather, molded plastic or extruded plastic, and the first straight magnetic wire may be a braided wire. Each of the magnets may be a spherical magnet, and each non-magnetic spacer may be a cylinder made of a foam material. Adjacent ones of the magnets and non-magnetic spacers may be abutted against each other. Each of the magnets in the first alternating sequence may be disposed with its respective first and second magnetic poles oriented in the inward and outward directions, respectively. The first longitudinal pocket may be formed by a Class 3 bound seam or a Class 6 edge finishing seam, and the first binding strip may be made of a flexible, non-magnetic material that is a same material or a different material as the generally elongate sheet. The first longitudinal edge portion may be fastened to the main portion of the sheet or the longitudinal strip edges may be fastened to the sheet by stitching, gluing, stapling, staking or melting.

The drape element may further include a second longitudinal pocket disposed proximate the second longitudinal sheet edge. The second longitudinal pocket may be formed by: (iii) a second longitudinal edge portion of the sheet proximate the second longitudinal sheet edge being turned and fastened to a main portion of the sheet, or (iv) a second binding strip having opposed longitudinal second strip edges being longitudinally folded about the second longitudinal sheet edge and the longitudinal second strip edges being fastened to the main portion of the sheet. A second straight magnetic wire may be disposed in the longitudinal direction within an inward longitudinal portion of the second longitudinal pocket, and a second alternating sequence of magnets and non-magnetic spacers may be disposed within an outward longitudinal portion of the second longitudinal pocket. Each of the magnets of the second alternating sequence may have opposed first and second magnetic poles corresponding to those of the magnets of the first alternating sequence, wherein a respective second magnetic pole of each of the magnets in the second alternating sequence may be disposed in contact with the second straight magnetic wire.

Alternatively, the drape element may further include a second longitudinal pocket disposed proximate the second longitudinal sheet edge and a second alternating sequence of magnetic members and non-magnetic spacers disposed within an outward longitudinal portion of the second longitudinal pocket, wherein the magnets and the magnetic members have first and second longitudinal spacing patterns, respectively, that are substantially the same as each other. This second longitudinal pocket may be formed by a second longitudinal edge portion of the sheet proximate the second longitudinal sheet edge being turned and fastened to a main portion of the sheet, or by a second binding strip having opposed longitudinal second strip edges being longitudinally folded about the second longitudinal sheet edge and the longitudinal second strip edges being fastened to the sheet.

According to another embodiment, a drape element includes: (i) a generally elongate sheet of flexible, non-magnetic material having opposed first and second longitudinal sheet edges defining a longitudinal direction and a longitudinal centerline toward which is defined an inward direction and away from which is defined an outward direction; (ii) first and second longitudinal pockets disposed proximate the first and second longitudinal sheet edges, respectively, wherein each of the longitudinal pockets is formed by a respective longitudinal edge portion of the sheet being turned and fastened to a main portion of the sheet; (iii) first and second straight magnetic wires each disposed in the longitudinal direction within a respective inward longitudinal portion of the first and second longitudinal pockets, respectively; and (iv) first and second alternating sequences of spherical magnets and cylindrical foam spacers, each alternating sequence disposed within a respective outward longitudinal portion of the first and second longitudinal pockets, respectively. Each of the spherical magnets has opposed first and second magnetic poles, wherein a respective first magnetic pole of each of the spherical magnets in the first alternating sequence is disposed in contact with the first straight magnetic wire, and wherein a respective second magnetic pole of each of the spherical magnets in the second alternating sequence is disposed in contact with the second straight magnetic wire.

The flexible, non-magnetic material may be woven fabric, felted fabric, leather, artificial leather, molded plastic or extruded plastic, and the first and second straight magnetic wires may be braided wires. Each of the respective longitudinal edge portions may be fastened to the main portion of the sheet by stitching, gluing, stapling, staking or melting.

According to yet another embodiment, a self-aligning drape assembly includes first and second sheets of flexible, non-magnetic material having first and second longitudinal straight edges, respectively, wherein for each of the first and second sheets respective longitudinal, outward and inward directions are defined as pointing along, toward and away from the respective longitudinal straight edge, respectively. The first and second sheets have respective first and second longitudinal pockets disposed proximate the first and second longitudinal straight edges, respectively, wherein each of the longitudinal pockets is formed by a respective longitudinal edge portion of the respective sheet being turned and fastened to a respective main portion of the respective sheet. The self-aligning drape assembly also includes first and second straight magnetic wires each disposed within respective inward longitudinal portions of the first and second longitudinal pockets, respectively, and first and second alternating sequences of spherical magnets and cylindrical foam spacers, each alternating sequence disposed within a respective outward longitudinal portion of the first and second longitudinal pockets, respectively. Each of the spherical magnets has opposed first and second magnetic poles wherein a respective first magnetic pole of each of the spherical magnets in the first alternating sequence is disposed in contact with the first straight magnetic wire, and wherein a respective second magnetic pole of each of the spherical magnets in the second alternating sequence is disposed in contact with the second straight magnetic wire. The first and second sheets are configured to be arranged coplanarly with the first and second longitudinal straight edges disposed side-by-side and with the second magnetic poles of the spherical magnets in the first alternating sequence being disposed in magnetic contact with the first magnetic poles of the spherical magnets in the second alternating sequence.

Each of the first and second sheets may have respective opposed first and second lateral edges disposed orthogonal to the respective first or second longitudinal straight edge, and the self-aligning drape assembly may further include a respective set of one or more weights attached along each of the second lateral edges. The self-aligning drape assembly may further include a header configured for attachment to a lintel and including a first array of magnets and/or magnetic elements along a length of the header, wherein each of the first and second sheets includes a respective second array of magnets and/or magnetic elements disposed along the first lateral edge thereof for magnetic coupling between the header and the first and second sheets. The flexible, non-magnetic material may be woven fabric, felted fabric, leather, artificial leather, molded plastic or extruded plastic.

The above features and advantages, and other features and advantages, of the present teachings are readily apparent from the following detailed description of some of the best modes and other embodiments for carrying out the present teachings, as defined in the appended claims, when taken in connection with the accompanying drawings.

DETAILED DESCRIPTION

Figure 1:
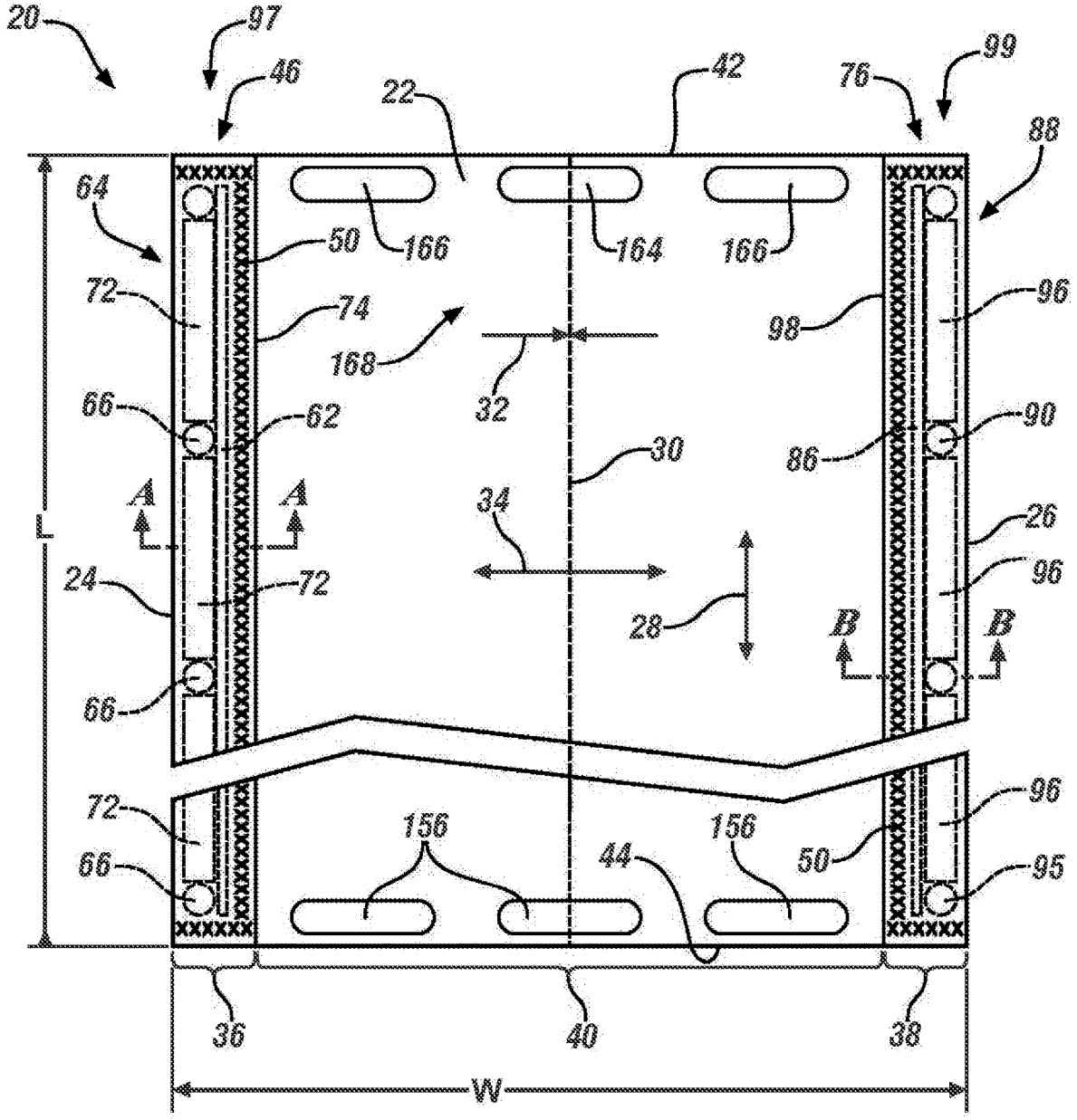
FIG. 1 is a schematic front plan view of a drape element in accordance with the present disclosure.

Referring now to the drawings, wherein like numerals indicate like parts in the several views, various configurations of a drape element 20 and a self-aligning drape assembly 100 are shown and described herein. The drape elements 20 and self-aligning drape assemblies 100 of the present disclosure provide great ability for the individual drape elements 20 to seal against each other, which can enhance sealing and privacy, as well as great ability for the drape elements 20 to readily unfurl from a rolled-up state into a straightened-out state.

Note that various components of the drape elements 20 and self-aligning drape assemblies 100 may be described herein as being made of a material that is magnetic or non-magnetic. As used herein, "magnetic" refers to materials or objects that are attracted toward magnets and/or to which magnets are attracted; examples of magnetic materials include iron, nickel, cobalt and alloys of the foregoing such as steel. Contrarily, "non-magnetic" refers to materials or objects that are not magnetic, and thus are not attracted toward or by magnets; examples of non-magnetic materials include metals such as copper, aluminum and titanium, as well as plastics, elastomers, fabrics, paper materials and the like. As used herein, a "magnet" refers to a component made of a magnetic material and which exhibits the typical qualities of a magnet; e.g., magnets have two opposed magnetic poles—sometimes referred to as "North" and "South" poles—and magnets are attracted toward objects made of a magnetic material. The North pole of one magnet is attracted toward and by the South pole of another magnet, and vice versa (i.e., opposite types of poles attract each other). Further, the North pole of one magnet is repelled by the North pole of another magnet, and likewise the South pole of one magnet is repelled by the South pole of another magnet (i.e., same types of poles repel each other). Thus, magnets are made of magnetic materials, but not all objects made of magnetic materials are magnets.

FIG. 1 shows a schematic front plan view of a drape element 20 in accordance with the present disclosure. The drape element 20 includes a generally elongate sheet 22 of flexible, non-magnetic material, such as woven fabric, felted fabric, leather, artificial leather, molded plastic or extruded plastic. The sheet 22 has opposed first and second longitudinal sheet edges 24,26 defining a longitudinal direction 28, a longitudinal centerline 30 toward which is defined an inward direction 32 and away from which is defined an outward direction 34. The inward and outward directions 32, 34 define a lateral direction which is generally orthogonal to the longitudinal direction 28. The sheet 22 also has a first (top) lateral edge 42 at a top of the sheet 22, and a second (bottom) lateral edge 44 at a bottom of the sheet. As illustrated in FIG. 1, the sheet 22 may be generally rectangular with relatively sharp corners as shown, or some or all of the corners may have radiused or rounded. Either or both of the first and second lateral edges 42, 44 may be straight or curved. The sheet 22 may have an overall length L as measured in the longitudinal direction 28 between the first and second lateral edges 42, 44 and an overall width W as measured in the lateral direction between the first and second longitudinal edges 24, 26.

Figure 2:
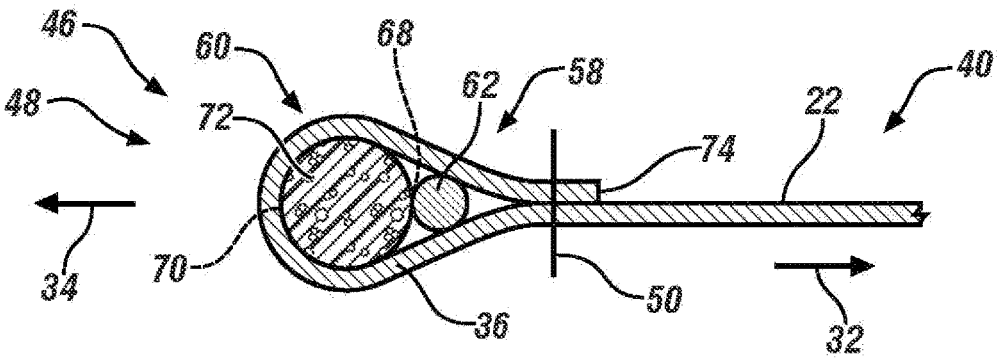
FIG. 2 is a schematic cross-sectional view of the drape element of FIG. 1 as viewed along line A-A thereof.
Figure 3:
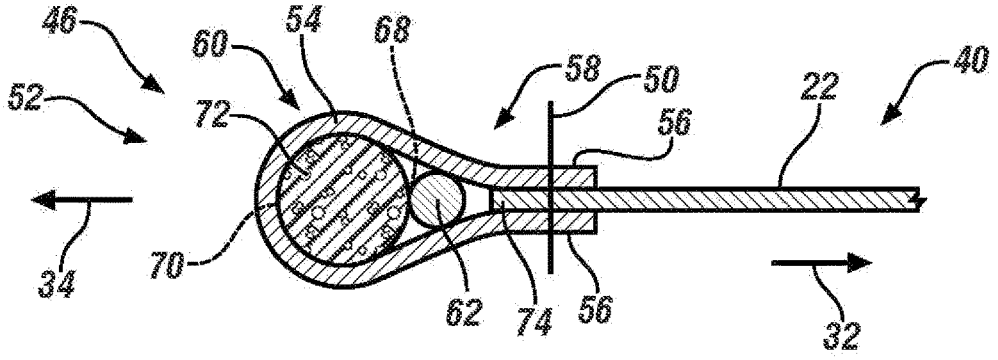
FIG. 3 is an alternative schematic cross-sectional view of the drape element of FIG. 1 as viewed along line A-A thereof.

A first longitudinal pocket 46 is disposed proximate (e.g., near and along the length of) the first longitudinal sheet edge 24. As shown in FIG. 2, this pocket 46 may be formed by a first longitudinal edge portion 36 of the sheet 22 proximate the first longitudinal sheet edge 24 being turned and fastened to a main portion 40 of the sheet. As shown here, a free edge 74 of the sheet 22 may be folded over onto the main portion 40 of the sheet 22, and then one or more fastening lines 50 (described further below) may be used to fasten the free edge 74 to the main portion 40 of the sheet 22. Alternatively, as illustrated in FIG. 3, the pocket 46 may be formed by a first binding strip 54 having opposed longitudinal first strip edges 56 being longitudinally folded about the first longitudinal sheet edge 24 (e.g., about the free edge 74) with the longitudinal strip edges 56 being fastened to the main portion 40 of the sheet 22. The first binding strip 54 may be made of a flexible, non-magnetic material that may be the same material of which the sheet 22 is made, or it may be made of a different material from the sheet 22. The first longitudinal edge portion 36 may be fastened to the main portion 40 of the sheet 22 (see FIG. 2), or the longitudinal strip edges 56 may be fastened to the main portion 40 of the sheet 22 (see FIG. 3), by stitching, gluing, stapling, staking or melting (e.g., using ultrasonic welding/bonding). Thus, the one or more fastening lines 50 may comprise stitches, glue/adhesive, staples/rivets or the like, and/or the indicated portions of the sheet 22 may be staked or melted together at the one or more fastening lines 50. If the fastening line(s) 50 comprise stitches, then the formation of the first longitudinal pocket 46 as shown in FIG. 2 may be viewed as a Class 3 bound seam 52, and the formation of the first longitudinal pocket 46 as shown in FIG. 3 may be viewed as a Class 6 edge finishing seam 48, according to ISO 4916:1991. (See International Standard 4916, titled "Textiles—Seam Types—Classification and Terminology" (1991) issued by the International Standards Organization.)

The first longitudinal pocket 46 has an inward longitudinal portion 58 and an outward longitudinal portion 60. Within the inward longitudinal portion 58, a first straight magnetic wire 62 is disposed in the longitudinal direction 28. The first straight magnetic wire 62 may be a solid wire or a braided wire. This wire 62 may permit the sheet 22 and drape element 20 to be rolled up, while also aiding in straightening out the sheet 22 and drape element 20 and keeping them straight when unrolled from a rolled-up state.

Figure 8:
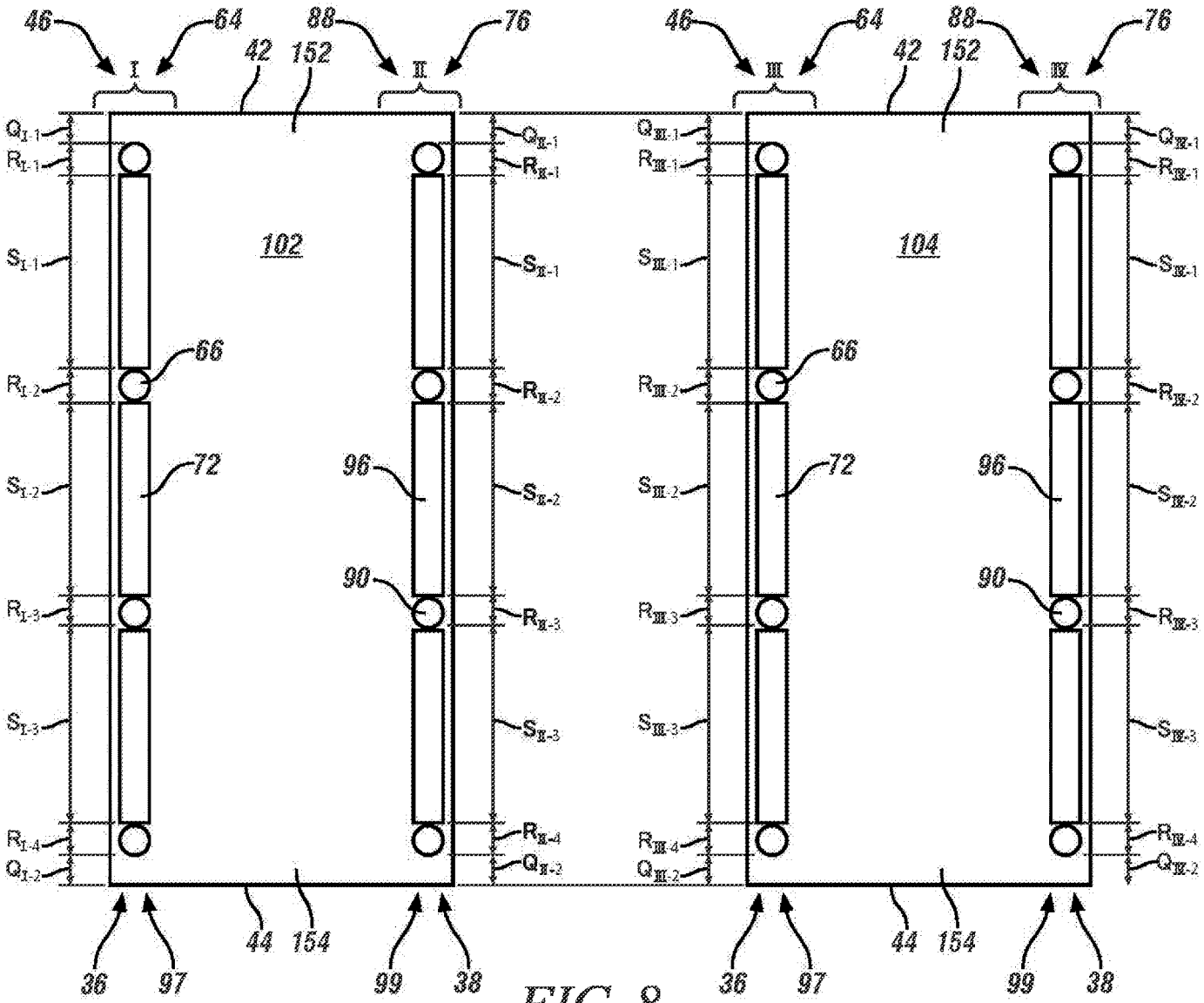
FIG. 8 is a schematic front plan view of two drape elements of a self-aligning drape assembly illustrating various first and second longitudinal spacing patterns.

Within the outward longitudinal portion 60 of the first longitudinal pocket 46, a first alternating sequence 64 of magnets 66 and non-magnetic spacers 72 is disposed. For example, as illustrated in FIGS. 1 and 8, the first alternating sequence 64 may start with a magnet 66 near the first (top) lateral edge 42 of the sheet 22 and another magnet 66 near the second (bottom) lateral edge 44, with an alternating spacer-magnet-spacer sequence in between. However, note that other alternating sequences may be used, such as starting and/or ending with a spacer 72 rather than with a magnet 66, and/or grouping two or more magnets 66 together at one or more points along the sequence. Each of the magnets 66 has opposed first and second magnetic poles 68,70, and a respective first magnetic pole 68 of each of the magnets 66 is disposed in contact with the first straight magnetic wire 62. Each of the magnets 66 may be a spherical magnet (e.g., a magnetized ball bearing) or any other shape. Each non-magnetic spacer 72 may be a cylinder or other shape made of a foam material, such as expanded polystyrene, expanded polypropylene or expanded polyurethane, or any other desired non-magnetic material (e.g., plastic). Adjacent ones of the magnets 66 and non-magnetic spacers 72 may be abutted against each other in the longitudinal direction 28. With the first pole 68 of each magnet 66 being in contact with the first straight magnetic wire 62, each of the magnets 66 in the first alternating sequence 64 may be disposed with its respective first and second magnetic poles 68, 70 oriented in the inward and outward directions, 32, 34 respectively. The direct physical and magnetic contact between the first pole 68 of each magnet 66 and the first straight magnetic wire 62 helps keep the first poles 68 oriented toward the wire 62. Once the magnets 66 are oriented with their first poles 68 in contact with the wire 62, the magnets 66 can be welded, brazed or otherwise adhered to the wire 62 in order to assure that the orientation will be maintained.

Figure 5:
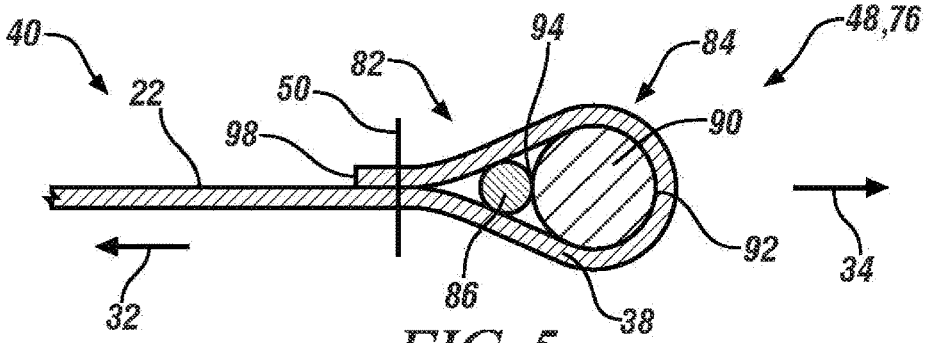
FIG. 5 is a schematic cross-sectional view of the drape element of FIG. 1 as viewed along line B-B thereof.
Figure 6:
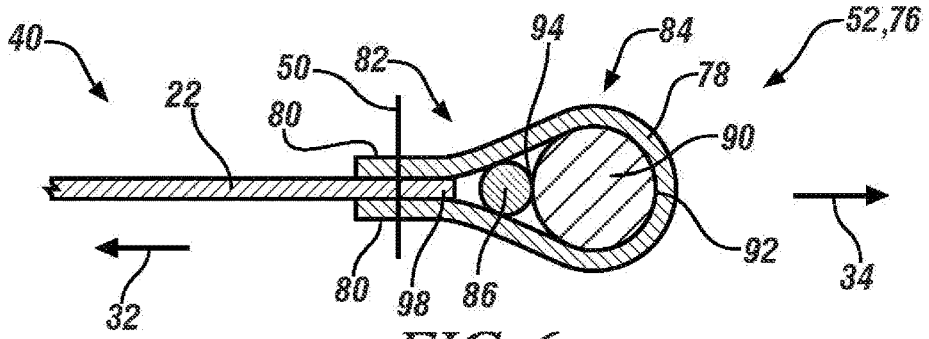
FIG. 6 is an alternative schematic cross-sectional view of the drape element of FIG. 1 as viewed along line B-B thereof.

As shown in FIGS. 1 and 8, the drape element 20 may further include a second longitudinal pocket 76 disposed proximate the second longitudinal sheet edge 26. Similar to the first longitudinal pocket 46, the second longitudinal pocket 76 may be formed by: (i) a second longitudinal edge portion 38 of the sheet 22 proximate the second longitudinal sheet edge 26 being turned and fastened to a main portion 40 of the sheet 22 (see FIG. 5); or (ii) a second binding strip 78 having opposed longitudinal second strip edges 80 being longitudinally folded about the second longitudinal sheet edge 26 and the longitudinal second strip edges 80 being fastened to the main portion 40 of the sheet 22 (see FIG. 6). As shown in FIG. 5, a free edge 98 of the sheet 22 may be folded over onto the main portion 40 of the sheet 22, and then one or more fastening lines 50 may be used to fasten the free edge 98 to the main portion 40 of the sheet 22. And as shown in FIG. 6, the opposed longitudinal first strip edges 80 may be longitudinally folded about the free edge 98 of the sheet 22 and fastened to the main portion 40. A second straight magnetic wire 86 may be disposed in the longitudinal direction 28 within an inward longitudinal portion 82 of the second longitudinal pocket 76, while a second alternating sequence 88 of magnets 90 and non-magnetic spacers 96 may be disposed within an outward longitudinal portion 84 of the pocket 76. The pattern of magnets 90 and non-magnetic spacers 96 in the second alternating sequence 88 may be substantially the same as the pattern of magnets 66 and non-magnetic spacers 72 in the first alternating sequence 64. Each of the magnets 90 of the second alternating sequence 88 may have opposed first and second magnetic poles 92,94 corresponding to the first and second magnetic poles 68, 70 of the magnets 66 of the first alternating sequence 64, with a respective second magnetic pole 94 of each of the magnets 90 in the second alternating sequence 88 being disposed in contact with the second straight magnetic wire 86. This arrangement causes the magnets 66 in the first longitudinal pocket 46 and the magnets 90 in the second longitudinal pocket 76 to all be oriented in the same way (i.e., with their respective first magnetic poles 68, 92 pointing in the same spatial direction, and their respective second magnetic poles 70, 94 pointing the opposite spatial direction.)

Alternatively, the second alternating sequence 88 may be a sequence of magnetic (but non-magnet) members 95 and non-magnetic spacers 96 (instead of magnets 90 and non-magnetic spacers 96). These magnetic members 95 may be made of a magnetic material (e.g., steel), and may take the form of non-magnetized spheres (e.g., ball bearings), discs, cubes, slugs, etc. In this arrangement where magnetic members 95 are used in the second alternating sequence 88 and second longitudinal pocket 76 instead of magnets 90, the second straight magnetic wire 86 would not be needed, since the magnetic members 95 are not magnets. Regardless of whether the second alternating sequence 88 includes magnets 90 or magnetic members 95, the magnets 66 in the first longitudinal pocket 46 are arranged in a first longitudinal spacing pattern 97, and the magnets 90 or magnetic members 95 in the second longitudinal pocket 76 are arranged in a second longitudinal spacing pattern 99, and these longitudinal spacing patterns 97, 99 may be substantially the same as each other. As used herein, a "longitudinal spacing pattern" means the set of measurements (as measured in the longitudinal direction 28) from the first or second lateral edge 42, 44 to the two extreme longitudinal edges of each magnet 66 (within the first longitudinal pocket 46), each magnet 90 (within the second longitudinal pocket 76) and/or each magnetic member 95 (within the second longitudinal pocket 76).

For example, FIG. 8 shows first and second sheets 102, 104 (both of which are sheets 20) disposed side-by-side but separated apart from each other, and illustrating an example of how the longitudinal spacing patterns 97, 99 may be measured from the first (top) lateral edge 42, 152. Note that the first sheet 102 has first and second longitudinal edges I and II (noted in the tables as "Edge I" and "Edge II", respectively), and the second sheet 104 has first and second longitudinal edges III and IV (noted in the table as "Edge III" and "Edge IV", respectively). (Also note that while the drawings show Edges I and III on the left side of the sheets 102, 104 and Edges II and IV on the right side of the sheets 102, 104, these orientations may also be reversed.) For the sake of simplicity, using the geometric shapes shown in FIG. 8, each of the magnets 66, 90 and magnetic members 95 may be referred to as a "BALL", and each of the spacers 72, 96 may be referred to as a "SPACER". Thus, each of the Edges I, II, III, IV has an alternating sequence of BALL, SPACER, BALL, SPACER, BALL, SPACER and BALL.

Each of the Edges I, II, III, IV begins with a spacing Q from the first (top) lateral edge 42, 152 to the top of the first BALL, and ends with another spacing Q from the bottom of the last BALL to the second (bottom) lateral edge 44, 154. Each BALL has a height of R and each SPACER has a height of S. Note that each of these measurements Q, R, S in FIG. 8 has two subscripts separated by a dash: the first subscript is a Roman numeral designating the Edge associated with the individual measurement, and the second subscript is an Arabic numeral designating the order of the individual measurement proceeding from the first (top) lateral edge 42, 152 to the second (bottom) lateral edge 44, 154. For example, $Q_{I\text{-}1}$ represents the first spacing along Edge I, and $Q_{IV\text{-}2}$ represents the second spacing along Edge IV. As another example, $R_{II\text{-}3}$ represents the height of the third BALL along Edge II, and $S_{III\text{-}3}$ represents the height of the third SPACER along Edge III. These measurements are set forth in TABLE 1 below.

TABLE 1

Spacings and Measurements of Elements Along Edges in FIG. 8

| Spacing/Measurement | Edge I | Edge II | Edge III | Edge IV |
|---|---|---|---|---|
| Spacing from top edge 42, 152 | $Q_{I\text{-}1}$ | $Q_{II\text{-}1}$ | $Q_{III\text{-}1}$ | $Q_{IV\text{-}1}$ |
| Height of first magnet/magnetic member | $R_{I\text{-}1}$ | $R_{II\text{-}1}$ | $R_{III\text{-}1}$ | $R_{IV\text{-}1}$ |
| Height of first non-magnetic spacer | $S_{I\text{-}1}$ | $S_{II\text{-}1}$ | $S_{III\text{-}1}$ | $S_{IV\text{-}1}$ |
| Height of second magnet/magnetic member | $R_{I\text{-}2}$ | $R_{II\text{-}2}$ | $R_{III\text{-}2}$ | $R_{IV\text{-}2}$ |
| Height of second non-magnetic spacer | $S_{I\text{-}2}$ | $S_{II\text{-}2}$ | $S_{III\text{-}2}$ | $S_{IV\text{-}2}$ |
| Height of third magnet/magnetic member | $R_{I\text{-}3}$ | $R_{II\text{-}3}$ | $R_{III\text{-}3}$ | $R_{IV\text{-}3}$ |
| Height of third non-magnetic spacer | $S_{I\text{-}3}$ | $S_{II\text{-}3}$ | $S_{III\text{-}3}$ | $S_{IV\text{-}3}$ |
| Height of fourth magnet/magnetic member | $R_{I\text{-}4}$ | $R_{II\text{-}4}$ | $R_{III\text{-}4}$ | $R_{IV\text{-}4}$ |
| Spacing from bottom edge 44, 154 | $Q_{I\text{-}2}$ | $Q_{II\text{-}2}$ | $Q_{III\text{-}2}$ | $Q_{IV\text{-}2}$ |

Each of the Edges I, II, III, IV includes a respective longitudinal edge portion, a respective longitudinal pocket, a respective alternating sequence of the BALLs and SPACERs, and a respective longitudinal spacing pattern of the BALLs and SPACERs. The reference numerals associated with each of the Edges I, II, III, IV is summarized in TABLE 2 below.

TABLE 2

Reference Numerals Associated with the Edges in FIG. 8

| Edges I and III (and ref. nums.) | | Edges II and IV (and ref. nums.) | |
|---|---|---|---|
| First longitudinal edge portion | 36, 120 | Second longitudinal edge portion | 38, 122 |
| First longitudinal pocket | 46, 116 | Second longitudinal pocket | 76, 118 |
| First alternating sequence | 64, 136 | Second alternating sequence | 88, 138 |
| First longitudinal spacing pattern | 97 | Second longitudinal spacing pattern | 99 |

Figure 4:
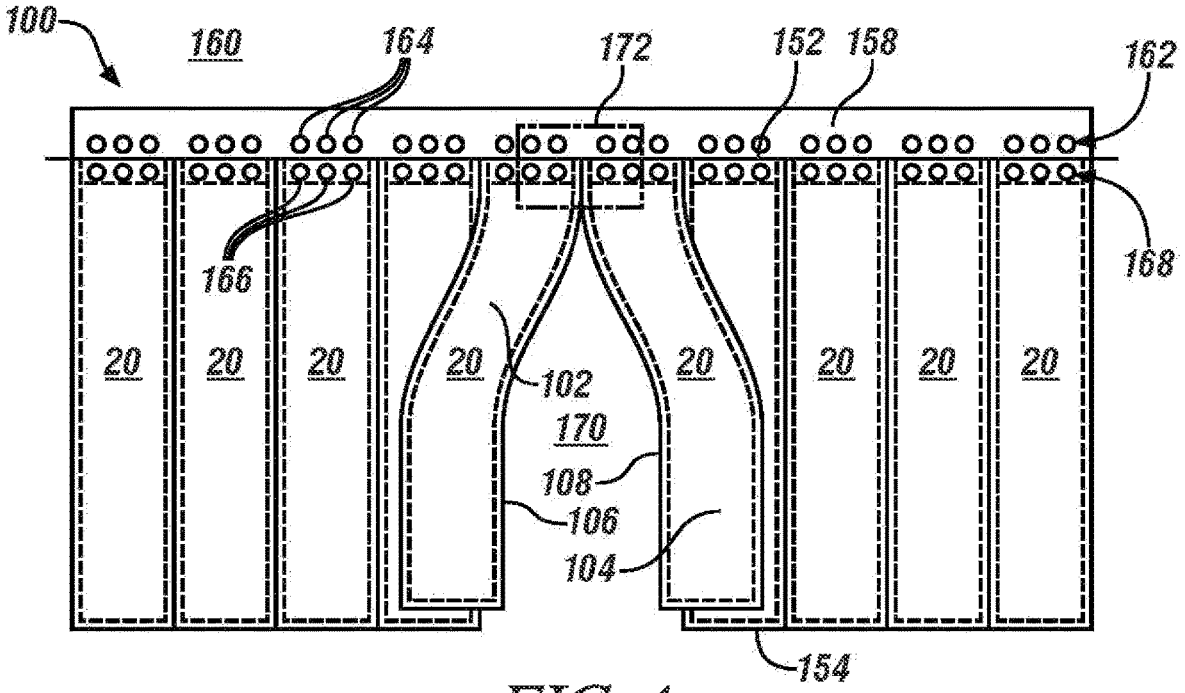
FIG. 4 is a schematic front plan view of a self-aligning drape assembly of individual drape elements.

According to one embodiment (as shown in FIGS. 1, 4 and 8), the drape element 20 includes: (i) a generally elongate sheet 22 of flexible, non-magnetic material having opposed first and second longitudinal sheet edges 24, 26 defining a longitudinal direction 28 and a longitudinal centerline 30 toward which is defined an inward direction 32 and away from which is defined an outward direction 34; (ii) first and second longitudinal pockets 46, 76 disposed proximate the first and second longitudinal sheet edges 24, 26, respectively, wherein each of the longitudinal pockets 46, 76 is formed by a respective longitudinal edge portion 36, 38 of the sheet 22 being turned and fastened to a main portion 40 of the sheet 22; (iii) first and second straight magnetic wires 62, 86 each disposed in the longitudinal direction 28 within a respective inward longitudinal portion 58, 82 of the first and second longitudinal pockets 46, 76, respectively; and (iv) first and second alternating sequences 64, 88 of spherical magnets 66, 90 and cylindrical foam spacers 96, with each alternating sequence 64, 88 being disposed within a respective outward longitudinal portion 60, 84 of the first and second longitudinal pockets 46, 76, respectively, wherein each of the spherical magnets 66, 90 has opposed first and second magnetic poles 92, 94, wherein a respective first magnetic pole 92 of each of the spherical magnets 66 in the first alternating sequence 64 is disposed in contact with the first straight magnetic wire 62, and wherein a respective second magnetic pole 94 of each of the spherical magnets 90 in the second alternating sequence 88 is disposed in contact with the second straight magnetic wire 86. In this embodiment, the first and second straight magnetic wires 62, 86 may be braided wires, and each of the respective longitudinal edge portions 36, 38 may be fastened to the main portion 40 of the sheet 22 by stitching, gluing, stapling, staking or melting.

Figure 7:
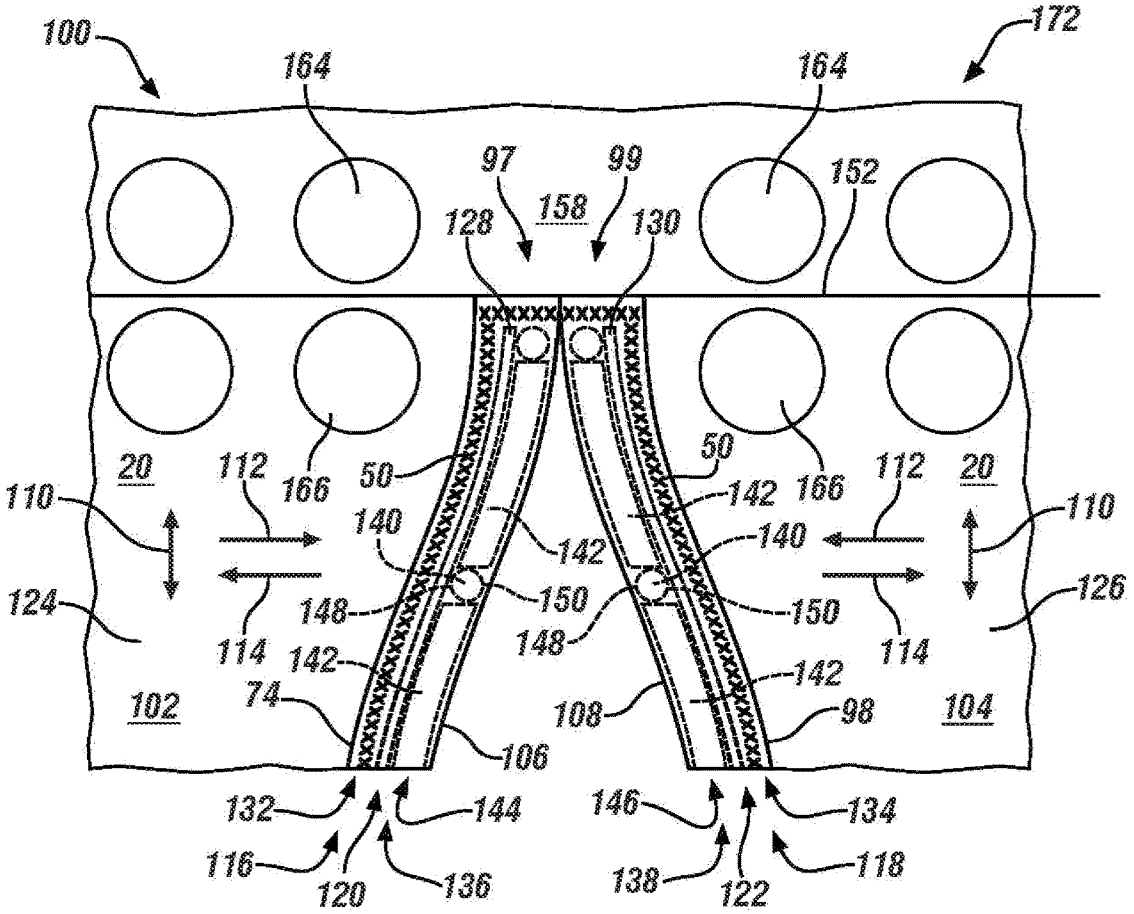
FIG. 7 is a schematic close-up view of the region bounded by the dashed rectangle in FIG. 4.

FIG. 4 shows a schematic front plan view of a self-aligning drape assembly 100 made of individual drape elements 20, and FIG. 7 shows a close-up of the region within the dashed rectangle 172 of FIG. 4. The self-aligning drape assembly 100 includes first and second sheets 102, 104 of flexible, non-magnetic material, with the first sheet 102 having a first longitudinal straight edge 106 and the second sheet 104 having a second longitudinal straight edge 108. The first sheet 102 has longitudinal, outward and inward directions 110, 112, 114 defined as pointing along, toward and away from the first longitudinal straight edge 106, respectively, while the second sheet 104 has longitudinal, outward and inward directions 110, 112, 114 defined as pointing along, toward and away from the second longitudinal straight edge 108, respectively. The first and second sheets 102, 104 have respective first and second longitudinal pockets 116, 118 disposed proximate the first and second longitudinal straight edges 106, 108, respectively, wherein each of the longitudinal pockets 116, 118 is formed by a respective longitudinal edge portion 120, 122 of the respective sheet 102, 104 being turned and fastened to a respective main portion 124, 126 of the respective sheet 102, 104.

A first straight magnetic wire 128 is disposed within an inward longitudinal portion 132 of the first longitudinal pocket 116, and a second straight magnetic wire 130 is disposed within an inward longitudinal portion 134 of the second longitudinal pocket 118. A first alternating sequence 136 of spherical magnets 140 and cylindrical foam spacers 142 is disposed within an outward longitudinal portion 144 of the first longitudinal pocket 116, and a second alternating sequence 138 of spherical magnets 140 and cylindrical foam spacers 142 is disposed within an outward longitudinal portion 146 of the second longitudinal pocket 118. Each of the spherical magnets 140 has opposed first and second magnetic poles 148, 150 wherein a respective first magnetic pole 148 of each of the spherical magnets 140 in the first alternating sequence 136 is disposed in contact with the first straight magnetic wire 128, and wherein a respective second magnetic pole 150 of each of the spherical magnets 140 in the second alternating sequence 138 is disposed in contact with the second straight magnetic wire 130.

The first and second sheets 102, 104 are configured to be arranged coplanarly (i.e., within the same plane) with the first and second longitudinal straight edges 106, 108 disposed side-by-side with respect to each other. Each of the two alternating sequences 136, 138 may be substantially the same, such that the spherical magnets 140 in the first longitudinal pocket 116 line up with the spherical magnets 140 in the second longitudinal pocket 118 when the sheets 102, 104 are disposed side-by-side as described. In this arrangement, the second magnetic poles 150 of the spherical magnets 140 in the first alternating sequence 136 (i.e., in the first longitudinal pocket 116) may be disposed in magnetic contact with the first magnetic poles 148 of the spherical magnets 140 in the second alternating sequence 138 (i.e., in the second longitudinal pocket 118).

As used herein, "magnetic contact" between one magnet and another magnet, or between a magnet and a magnetic object—i.e., between a first magnetomagnetic object and a second magnetomagnetic object—describes (i) direct physical contact between the first and second magnetomagnetic objects with no other object interposed between them, and/or (ii) indirect physical contact between the first and second magnetomagnetic objects with some object interposed between them. In both cases, the direct or indirect contact between the first and second magnetomagnetic objects is urged by the force of magnetic attraction between them. (Here, "magnetomagnetic" describes an object that is (i) a magnet, or (ii) made of a magnetic material but is not magnetized, and thus is not a magnet.) In the first and second sheets 102, 104, the spherical magnets 140 are disposed within the first and second longitudinal pockets 116, 118 with the spherical magnets 140 being enveloped or covered by the sheet material (e.g., cloth or fabric). Thus, when the sheets 102, 104 are arranged side-by-side as described above and as illustrated in FIGS. 4 and 7, the spherical magnets 140 along one longitudinal straight edge 106 are attracted to the spherical magnets 140 in the other longitudinal straight edge 108, and are urged into indirect physical contact with each other, with the sheet material of the longitudinal pockets 116, 118 interposed between the spherical magnets 140. This arrangement permits the sheets 102, 104 of the drape assembly 100 to be "self-aligning" in that the drape elements 20 or sheets 102, 104 may be arranged side-by-side as described above and the spherical magnets 140 disposed along each of the two longitudinal straight edges 106, 108 will correspondingly attract each other, particularly if the first and second alternating sequences 136, 138 are substantially the same as each other, and/or the first and second longitudinal spacing patterns 97, 99 are substantially the same as each other.

The first sheet 102 may have opposed first (top) and second (bottom) lateral edges 152, 154 disposed orthogonal to the first longitudinal straight edge 106, and similarly the second sheet 104 may have opposed first and second lateral edges 152, 154 disposed orthogonal to the second longitudinal straight edge 108 The self-aligning drape assembly 100 may further include a respective set of one or more weights 156 attached along each of the second (bottom) lateral edges 154. These weights 156 may assist in keeping the individual drape elements 20 straight.

The self-aligning drape assembly 100 may further include a header 158 configured for attachment to an overhead lintel 160 and including a first array 162 of magnets 164 and/or magnetic elements 166 along a length of the header 158. In this arrangement, each of the first and second sheets 102, 104 may include a respective second array 168 of magnets 164 and/or magnetic elements 166 disposed along the first (top) lateral edge 152 thereof for magnetic coupling between the header 158 and the first and second sheets 102, 104.

It was noted above that magnets are made of magnetic materials, but not all objects made of magnetic materials are magnets. For example, an ordinary object made of iron or steel is made of a magnetic material, but that alone does not make the object a magnet. An object is considered to be a magnet if (i) it is attracted toward other non-magnet objects that are made of magnetic material, and (ii) the object exhibits attraction toward and repulsion away from the poles of other magnets. However, magnetism is a relative phenomenon which may be exhibited in varying degrees. For example, an object made of a magnetic material and which is not normally considered to be a magnet may nonetheless exhibit a very weak amount of magnetism after having been placed in proximity to a strong magnet; in such as case, the object would still not be considered to be a magnet because the degree of magnetism it exhibits is so weak and de minimis.

The above description is intended to be illustrative, and not restrictive. While the dimensions and types of materials described herein are intended to be illustrative, they are by no means limiting and are exemplary embodiments. In the following claims, use of the terms "first", "second", "top", "bottom", etc. are used merely as labels, and are not intended to impose numerical or positional requirements on their objects. As used herein, an element or step recited in the singular and preceded by the word "a" or "an" should be understood as not excluding plural of such elements or steps, unless such exclusion is explicitly stated. Additionally, the phrase "at least one of A and B" and the phrase "A and/or B" should each be understood to mean "only A, only B, or both A and B". Furthermore, references to a particular embodiment or example are not intended to be interpreted as excluding the existence of additional embodiments or examples that also incorporate the recited features. And when broadly descriptive adverbs such as "substantially" and "generally" are used herein to modify an adjective, such as in the phrase "substantially circular" or "generally circular", these adverbs mean "for the most part", "to a significant extent" and/or "to a large degree", and do not necessarily mean "perfectly", "completely", "strictly" or "entirely". Additionally, the word "proximate" may be used herein to describe the location of an object or portion thereof with respect to another object or portion thereof, and/or to describe the positional relationship of two objects or their respective portions thereof with respect to each other, and may mean "near", "adjacent", "close to", "close by", "at" or the like.

This written description uses examples, including the best mode, to enable those skilled in the art to make and use devices, systems and compositions of matter, and to perform methods, according to this disclosure. It is the following claims, including equivalents, which define the scope of the present disclosure.

What is claimed is:

1. A drape element, comprising:

a generally elongate sheet of flexible, non-magnetic material having opposed first and second longitudinal sheet edges defining a longitudinal direction, a longitudinal centerline toward which is defined an inward direction and away from which is defined an outward direction, and a first longitudinal pocket disposed proximate the first longitudinal sheet edge and being formed by:

a first longitudinal edge portion of the sheet proximate the first longitudinal sheet edge being turned and fastened to a main portion of the sheet, or a first binding strip having opposed longitudinal first strip edges being longitudinally folded about the first longitudinal sheet edge and the longitudinal strip edges being fastened to the main portion of the sheet;

a first straight magnetic wire disposed in the longitudinal direction within an inward longitudinal portion of the first longitudinal pocket; and a first alternating sequence of magnets and non-magnetic spacers disposed within an outward longitudinal portion of the first longitudinal pocket, wherein each of the magnets has opposed North and South magnetic poles, and wherein all of the magnets have their respective North magnetic poles disposed in contact with the first straight magnetic wire or all of the magnets have their respective South magnetic poles disposed in contact with the first straight magnetic wire.

2. A drape element according to claim 1, wherein the flexible, non-magnetic material is woven fabric, felted fabric, leather, artificial leather, molded plastic or extruded plastic.

3. A drape element according to claim 1, wherein the first straight magnetic wire is a braided wire.

4. A drape element according to claim 1, wherein each of the magnets is a spherical magnet.

5. A drape element according to claim 1, wherein each non-magnetic spacer is a cylinder made of a foam material.

6. A drape element according to claim 1, wherein adjacent ones of the magnets and non-magnetic spacers are abutted against each other.

7. A drape element according to claim 1, wherein all of the magnets in the first alternating sequence are disposed with their respective North and South magnetic poles all oriented in the inward and outward directions, respectively, or with their respective North and South magnetic poles all oriented in the outward and inward directions, respectively.

8. A drape element according to claim 3, wherein the braided wire permits the drape element to be rolled into a rolled-up state and to readily unfurl from the rolled-up state into a straightened-out state.

9. A drape element according to claim 1, wherein the first binding strip is made of a flexible, non-magnetic material that is a same material or a different material as the generally elongate sheet.

10. A drape element according to claim 1, wherein the first longitudinal edge portion is fastened to the main portion of the sheet or the longitudinal strip edges are fastened to the sheet by stitching, gluing, stapling, staking or melting.

11. A drape element according to claim 1, further including:

a second longitudinal pocket disposed proximate the second longitudinal sheet edge and being formed by:

a second longitudinal edge portion of the sheet proximate the second longitudinal sheet edge being turned and fastened to a main portion of the sheet; or a second binding strip having opposed longitudinal second strip edges being longitudinally folded about the second longitudinal sheet edge and the longitudinal second strip edges being fastened to the main portion of the sheet;

a second straight magnetic wire disposed in the longitudinal direction within an inward longitudinal portion of the second longitudinal pocket; and a second alternating sequence of magnets and non-magnetic spacers disposed within an outward longitudinal portion of the second longitudinal pocket, wherein each of the magnets of the second alternating sequence has opposed North and South magnetic poles, and wherein if a respective North magnetic pole of each of the magnets in the first alternating sequence is disposed in contact with the first straight magnetic wire then a respective South magnetic pole of each of the magnets in the second alternating sequence is disposed in contact with the second straight magnetic wire, and if a respective South magnetic pole of each of the magnets in the first alternating sequence is disposed in contact with the first straight magnetic wire then a respective North magnetic pole of each of the magnets in the second alternating sequence is disposed in contact with the second straight magnetic wire.

12. A drape element according to claim 1, further including:

a second longitudinal pocket disposed proximate the second longitudinal sheet edge and being formed by:

a second longitudinal edge portion of the sheet proximate the second longitudinal sheet edge being turned and fastened to a main portion of the sheet; or a second binding strip having opposed longitudinal second strip edges being longitudinally folded about the second longitudinal sheet edge and the longitudinal second strip edges being fastened to the main portion of the sheet; and a second alternating sequence of magnetic members and non-magnetic spacers disposed within an outward longitudinal portion of the second longitudinal pocket;

wherein the magnets and the magnetic members have first and second longitudinal spacing patterns, respectively, that are substantially the same as each other.

13. A drape element, comprising:

a generally elongate sheet of flexible, non-magnetic material having opposed first and second longitudinal sheet edges defining a longitudinal direction and a longitudinal centerline toward which is defined an inward direction and away from which is defined an outward direction;

first and second longitudinal pockets disposed proximate the first and second longitudinal sheet edges, respectively, wherein each of the longitudinal pockets is formed by a respective longitudinal edge portion of the sheet being turned and fastened to a main portion of the sheet;

first and second straight magnetic wires each disposed in the longitudinal direction within a respective inward longitudinal portion of the first and second longitudinal pockets, respectively; and first and second alternating sequences of spherical magnets and cylindrical foam spacers, each alternating sequence disposed within a respective outward longitudinal portion of the first and second longitudinal pockets, respectively, wherein each of the spherical magnets has opposed North and South magnetic poles, wherein either a respective North magnetic pole of each of the spherical magnets in the first alternating sequence is disposed in contact with the first straight magnetic wire and a respective South magnetic pole of each of the spherical magnets in the second alternating sequence is disposed in contact with the second straight magnetic wire, or a respective South magnetic pole of each of the spherical magnets in the first alternating sequence is disposed in contact with the first straight magnetic wire and a respective North magnetic pole of each of the spherical magnets in the second alternating sequence is disposed in contact with the second straight magnetic wire.

14. A drape element according to claim 13, wherein the flexible, non-magnetic material is woven fabric, felted fabric, leather, artificial leather, molded plastic or extruded plastic.

15. A drape element according to claim 13, wherein the first and second straight magnetic wires are braided wires.

16. A drape element according to claim 13, wherein each of the respective longitudinal edge portions is fastened to the main portion of the sheet by stitching, gluing, stapling, staking or melting.

17. A self-aligning drape assembly comprising:

first and second sheets of flexible, non-magnetic material having first and second longitudinal straight edges, respectively, wherein for each of the first and second sheets respective longitudinal, outward and inward directions are defined as pointing along, toward and away from the respective longitudinal straight edge, respectively, the first and second sheets having respective first and second longitudinal pockets disposed proximate the first and second longitudinal straight edges, respectively, wherein each of the longitudinal pockets is formed by a respective longitudinal edge portion of the respective sheet being turned and fastened to a respective main portion of the respective sheet;

first and second straight magnetic wires each disposed within respective inward longitudinal portions of the first and second longitudinal pockets, respectively; and first and second alternating sequences of spherical magnets and cylindrical foam spacers, each alternating sequence disposed within a respective outward longitudinal portion of the first and second longitudinal pockets, respectively, wherein each of the spherical magnets has opposed North and South magnetic poles, wherein either a respective North magnetic pole of each of the spherical magnets in the first alternating sequence is disposed in contact with the first straight magnetic wire and a respective South magnetic pole of each of the spherical magnets in the second alternating sequence is disposed in contact with the second straight magnetic wire, or a respective South magnetic pole of each of the spherical magnets in the first alternating sequence is disposed in contact with the first straight magnetic wire and a respective North magnetic pole of each of the spherical magnets in the second alternating sequence is disposed in contact with the second straight magnetic wire;

wherein the first and second sheets are configured to be arranged coplanarly with the first and second longitudinal straight edges disposed side-by-side and with the spherical magnets in the first alternating sequence being disposed in magnetic contact with the spherical magnets in the second alternating sequence.

18. A self-aligning drape assembly according to claim 17, wherein each of the first and second sheets has respective opposed first and second lateral edges disposed orthogonal to the respective first or second longitudinal straight edge, and further comprising a respective set of one or more weights attached along each of the second lateral edges.

19. A self-aligning drape assembly according to claim 18, further comprising a header configured for attachment to a lintel and including a first array of magnets and/or magnetic elements along a length of the header, wherein each of the first and second sheets includes a respective second array of magnets and/or magnetic elements disposed along the first lateral edge thereof for magnetic coupling between the header and the first and second sheets.

20. A self-aligning drape assembly according to claim 17, wherein the flexible, non-magnetic material is woven fabric, felted fabric, leather, artificial leather, molded plastic or extruded plastic.

* * * * *